US006619068B2

(12) United States Patent
Suh

(10) Patent No.: US 6,619,068 B2
(45) Date of Patent: Sep. 16, 2003

(54) SELF-COOLING BEVERAGE CONTAINER

(75) Inventor: Won Gil Suh, Seoul (KR)

(73) Assignee: Icetec, Inc., Seoul (KR)

( * ) Notice: Subject to any disclaimer, the term of this patent is extended or adjusted under 35 U.S.C. 154(b) by 0 days.

(21) Appl. No.: 10/083,478

(22) Filed: Feb. 27, 2002

(65) Prior Publication Data

US 2002/0116942 A1 Aug. 29, 2002

(30) Foreign Application Priority Data

Feb. 28, 2001 (KR) ..... 2001-10524

(51) Int. Cl.[7] ..... F25D 3/08
(52) U.S. Cl. ..... 62/371; 62/294; 165/163
(58) Field of Search ..... 62/371, 60, 294, 62/293, 457.9; 165/163, 438

(56) References Cited

U.S. PATENT DOCUMENTS 3,309,890 A * 3/1967 Barnett et al. ..... 62/294
3,525,236 A * 8/1970 Solhkhah ..... 62/294
3,597,937 A * 8/1971 Parks ..... 62/294
3,636,726 A * 1/1972 Rosenfeld et al. ..... 62/294
3,759,060 A * 9/1973 Chase ..... 62/294
4,640,102 A * 2/1987 Tenenbaum et al. ..... 62/294
4,669,273 A 6/1987 Fischer et al.
5,394,703 A 3/1995 Anthony
5,765,385 A 6/1998 Childs

FOREIGN PATENT DOCUMENTS

EP 0931998 A2 * 7/1999

* cited by examiner

*Primary Examiner*—Chen Wen Jiang

(57) ABSTRACT

Provided is a self-cooling beverage container. The self-cooling beverage container includes a refrigerant vessel provided inside the beverage container and having a refrigerant valve configured to exhaust an internal refrigerant outside, an evaporator tubing having one end connected to the refrigerant valve and the other end led to the outside of a container body to allow evaporation of the refrigerant exhausted through the refrigerant valve and to remove an evaporation heat for the refrigerant from the beverage to cool the beverage, and a refrigerant valve actuator configured to actuate the refrigerant valve, if necessary. Since evaporation occurs directly at an evaporator tubing contacting a beverage inside the container through a wide area, superb beverage cooling efficiency can be achieved. Also, a lid member can be opened by pulling a handle or lightly touching or pressing a convex portion, that is, the self-cooling beverage container can be easily manipulated.

4 Claims, 8 Drawing Sheets

SELF-COOLING BEVERAGE CONTAINER

TECHNICAL FIELD

The present invention relates to a self-cooling beverage container, and more particularly, to a self-cooling beverage container adapted to provide cold beverage by cooling beers, soft drinks or other beverages using a refrigerant contained in a refrigerant vessel provided inside a beverage container.

BACKGROUND ART

Various cooling apparatuses using a refrigerant have been hitherto developed. The refrigerant used must have a large evaporation latent heat and a small specific heat of a liquid or a small ratio of the specific heat to evaporation heat so as to reduce the temperature of a beverage with a small amount of a refrigerant in a refrigerant chamber provided inside a beverage container. Also, since the refrigerant stored in the refrigerant chamber cannot be used when it coagulates at high temperature, the refrigerant used must have a low coagulation temperature so as to be used at low temperature.

Alternatively, from the viewpoint of structure, there have previously been proposed the following techniques: using pressurized gas; using heat exchange between a beverage and reactants arising due to a reaction between water and chemicals; and using jetting of pressurized gas into a beverage to cool the beverage.

Also, various types of cooling apparatuses in combinations of characteristics of refrigerants and structures of refrigerant chambers, have been developed to accomplish such desired self-cooling. That is, there have been continuously developed various types of apparatuses including an apparatus in which a contact area between a beverage and a refrigerant chamber is increased by providing a large horizontal or vertical space of the refrigerant chamber for achieving a maximized cooling area, and an apparatus in which a refrigerant stored in a refrigerant chamber has improved characteristics including a low condensing pressure, a high critical temperature, a low coagulation temperature and a large evaporation latent heat while the refrigerant chamber is simply constructed of a cup shaped.

There have been many existing techniques of self-cooling beverage containers, but none have been successful commercially, because novel refrigerants have not yet acquired governmental authorization with respect to safety and have encountered reduced practicability due to low refrigeration speed. Also, in the case of using pressurized gas, cooling efficiency is lowered when the expansion of a refrigerant chamber storing the pressurized gas is minimized, and the refrigerant chamber may explode at room temperature when the refrigerant chamber is expanded, making commercial use of self-cooling beverage containers impossible.

In particular, in the case of using pressurized gas, an attempt at maximizing cooling efficiency has been made, that is, a refrigerant chamber is constructed so as to increase its contact area with a beverage by forming a plurality of openings. However, the above described type of refrigerant chambers show serious drawbacks that their air-tightness may be deteriorated and mass production thereof is impossible.

DISCLOSURE OF THE INVENTION

To solve the above-described problems, it is an object of the present invention to provide a self-cooling beverage container which has superb efficiency of cooling a beverage contained in the beverage container, which can remarkably reduce a cooling time and which can be easily manipulated so that even children or aged people can have cooled beverages easily.

To accomplish the above object, there is provided a self-cooling beverage container capable of accommodating a beverage and having a lid member formed at either side thereof to be opened, if necessary, to exhaust the beverage outside, the self-cooling beverage container comprising a refrigerant vessel provided inside the beverage container and having a refrigerant valve configured to exhaust an internal refrigerant outside, an evaporator tubing having one end connected to the refrigerant valve and the other end led to the outside of a container body to allow evaporation of the refrigerant exhausted through the refrigerant valve and to remove an evaporation heat for the refrigerant from the beverage to cool the beverage, and a refrigerant valve actuator configured to actuate the refrigerant valve, if necessary.

The top end of the refrigerant vessel is preferably disposed within a movable radius of the lid member when the lid member is severed and moved inside the beverage vessel, and the refrigerant valve actuator may include a lid member movable inside the beverage container and a handle installed on the lid member and capable of easily severing the lid member. In this case, the refrigerant valve is actuated as a refrigerant vessel is lowered by a force applied for opening the lid member through a handle.

The top end of the refrigerant vessel is preferably in contact with the lid member, more preferably lightly attached to or contacts the bottom of the lid member.

The refrigerant actuator may be a convex portion formed such that one upper end of the beverage container is made convex upward, for providing a recess to which the top end of the refrigerant vessel is connected inside the beverage container. In this case, the refrigerant vessel is lowered by a force applied thereto when the convex portion is lightly touched or pressed, so that the refrigerant valve is actuated.

Also, the self-cooling beverage container may further include an exhaust cap elevatably installed at one end of the evaporator tubing and having an exhaust hole for exhaustion of the evaporated refrigerant formed on its lateral surface. Here, a sound generating device may be installed in the exhaust cap so that characteristic sound can be generated while the evaporated refrigerant is exhausted through the exhaust hole. In this case, the sound is suitably generated according to the kind of beverage contained in the self-cooling beverage container.

Further, a tapering locking protrusion is preferably installed at the refrigerant vessel around the refrigerant vessel, and a wedge tube having a locking flange for preventing the locking protrusion from escaping outside once inserted, is preferably installed at the opposite end of the evaporator tubing facing the refrigerant valve. By doing so, the refrigerant valve is kept open once actuated, so that the refrigerant in the refrigerant vessel and evaporator tubing is all exhausted.

BRIEF DESCRIPTION OF THE DRAWINGS

The above objects and advantages of the present invention will become more apparent by describing in detail preferred embodiments thereof with reference to the attached drawings in which.

BEST MODE FOR CARRYING OUT THE INVENTION

A preferred embodiment of the present invention will now be described in detail with reference to the accompanying drawings.

Figure 1:
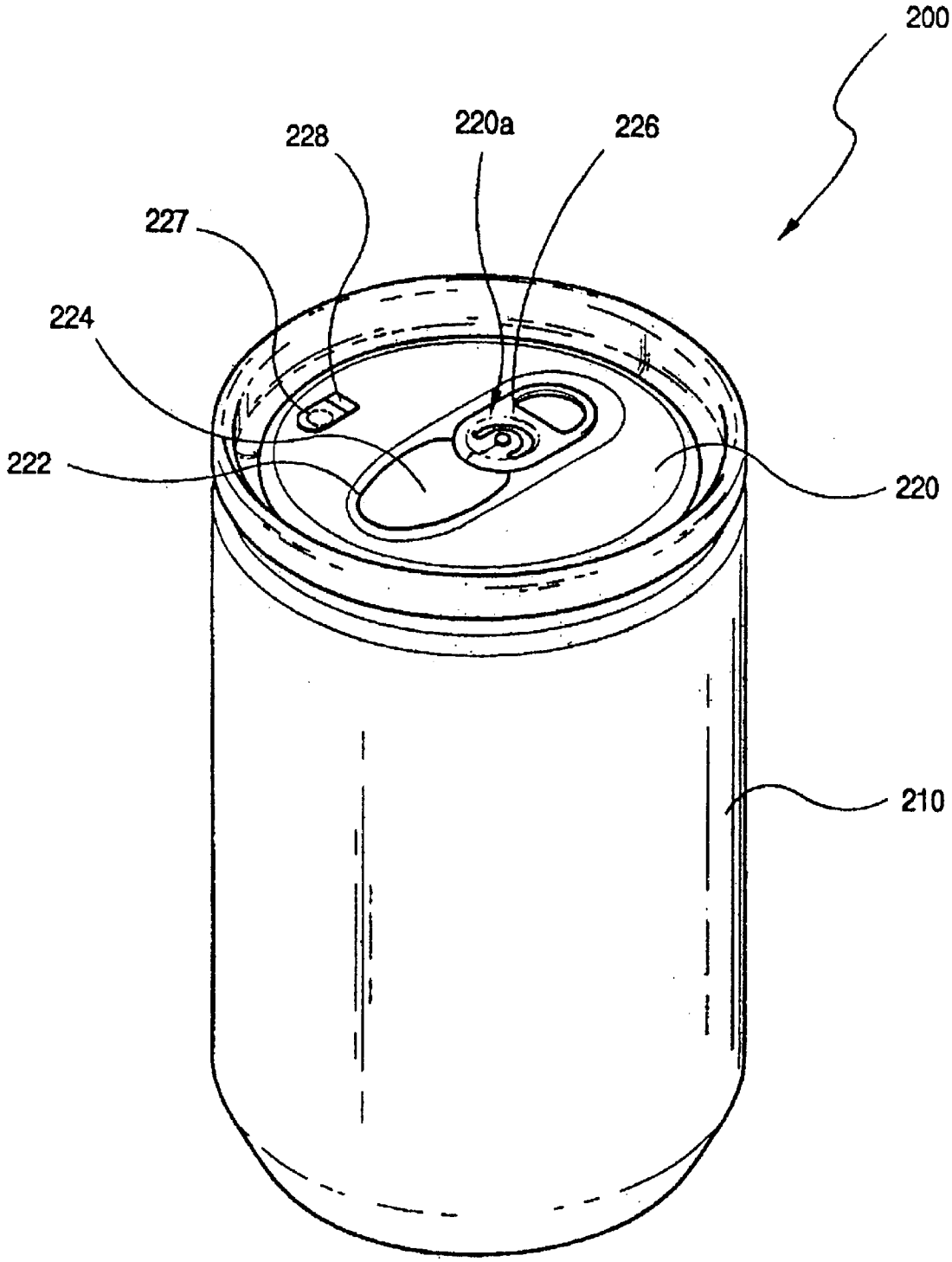
FIG. 1 is a perspective view of a beverage container according to a preferred embodiment of the present invention.
Figure 2:
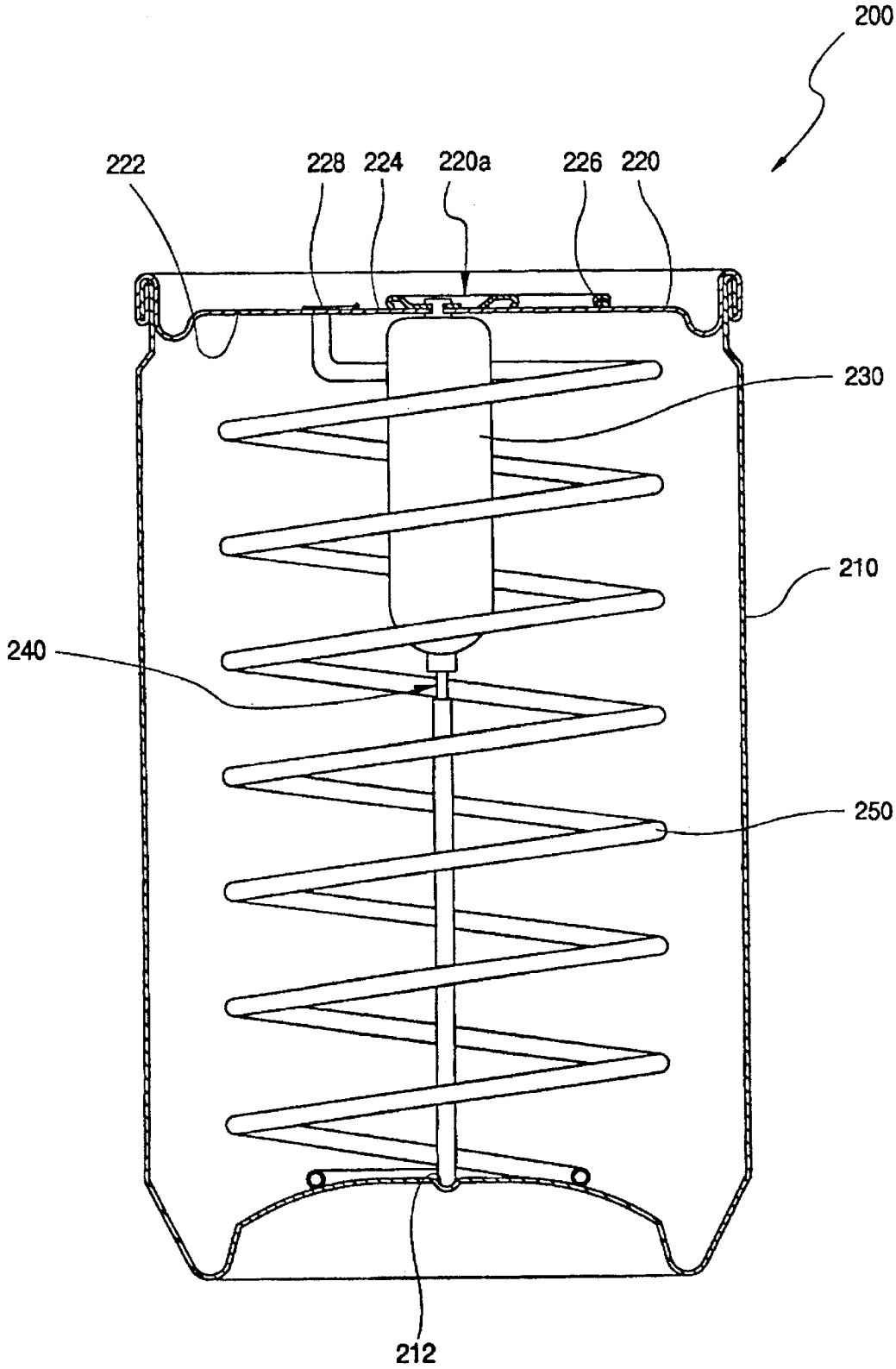
FIG. 2 is a cross-sectional view of the beverage container shown in FIG. 1.
Figure 3:
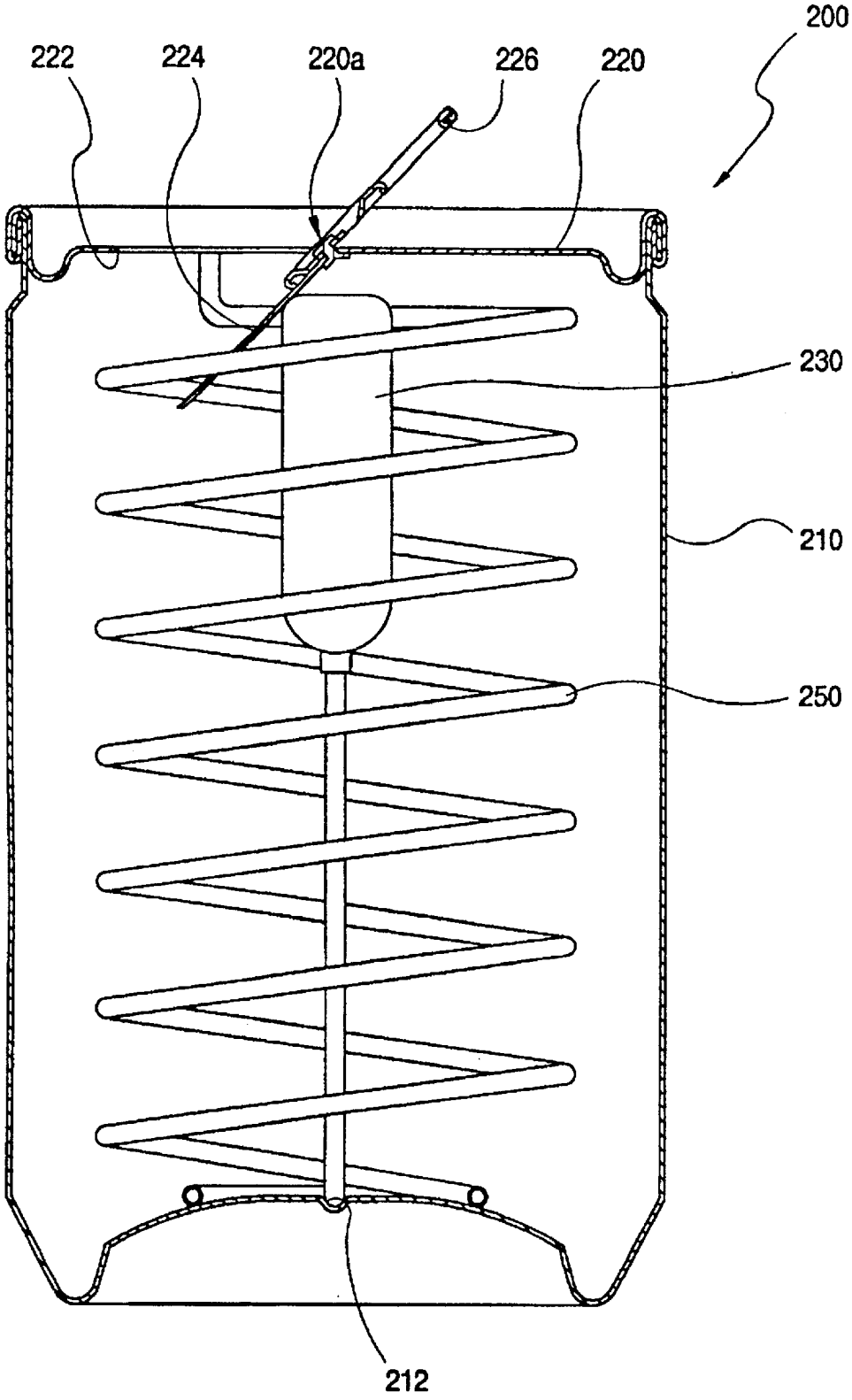
FIG. 3 is a cross-sectional view showing the state in which a lid member is opened.

Referring to FIGS. 1 through 3, a beverage container 200 according to the present invention includes a container body 210 for providing a space in which a beverage is contained, and a cover member 220 connected to the edge of the top surface of the container body 210 to cover the top surface of the container body 210. In the cover member 220 are provided a lid member 224 configured to be easily severed along a line 222, and a handle 226 connected to the lid member 224 so that the severed lid member 224 is bent inward the beverage container 200 just by applying a force to the lid member 224. This construction is the same as that of a general beverage can. The lid member 224 and the handle 226 also serve as a valve actuator 220*a* of the beverage container 200 according to the present invention. The valve actuator 220*a* may be differently constructed as far as it can actuate a refrigerant valve 240 to be described later, if necessary. A support hole 212 is provided in the bottom of the container body 210. The support hole 212 is provided for supporting an evaporator tubing 250 to be described later so as not to move.

As shown in the drawings, a refrigerant vessel 230 in which a refrigerant, e.g., a compressed carbon dioxide liquid, is accommodated is provided inside the beverage container 200. The refrigerant vessel 230 is preferably installed such that its top end contacts the bottom of the lid member 224, as shown in FIG. 2. In some cases, the top end of the refrigerant vessel 230 may be slightly spaced apart from the lid member 224 downward. The refrigerant vessel 230 of such a type must be arranged such that its opening faces downward. By doing so, the refrigerant liquid can be collected at the lower portion of the refrigerant vessel 230 even when the evaporation of the refrigerant continuously proceeds at the evaporator tubing 250, and the refrigerant being in a liquid phase is directly exhausted to the evaporator tubing 250 to then be evaporated accordingly. Thus, uniform, superb cooling efficiency can be achieved throughout the beverage.

The refrigerant valve 240 is installed at the lower opening of the refrigerant vessel 230. The refrigerant valve 240 is opened when necessary, that is, when the beverage is intended to drink, so that the refrigerant contained inside the refrigerant vessel 230 is exhausted for evaporation. This will now be described in detail with reference to FIG. 4.

Figure 4:
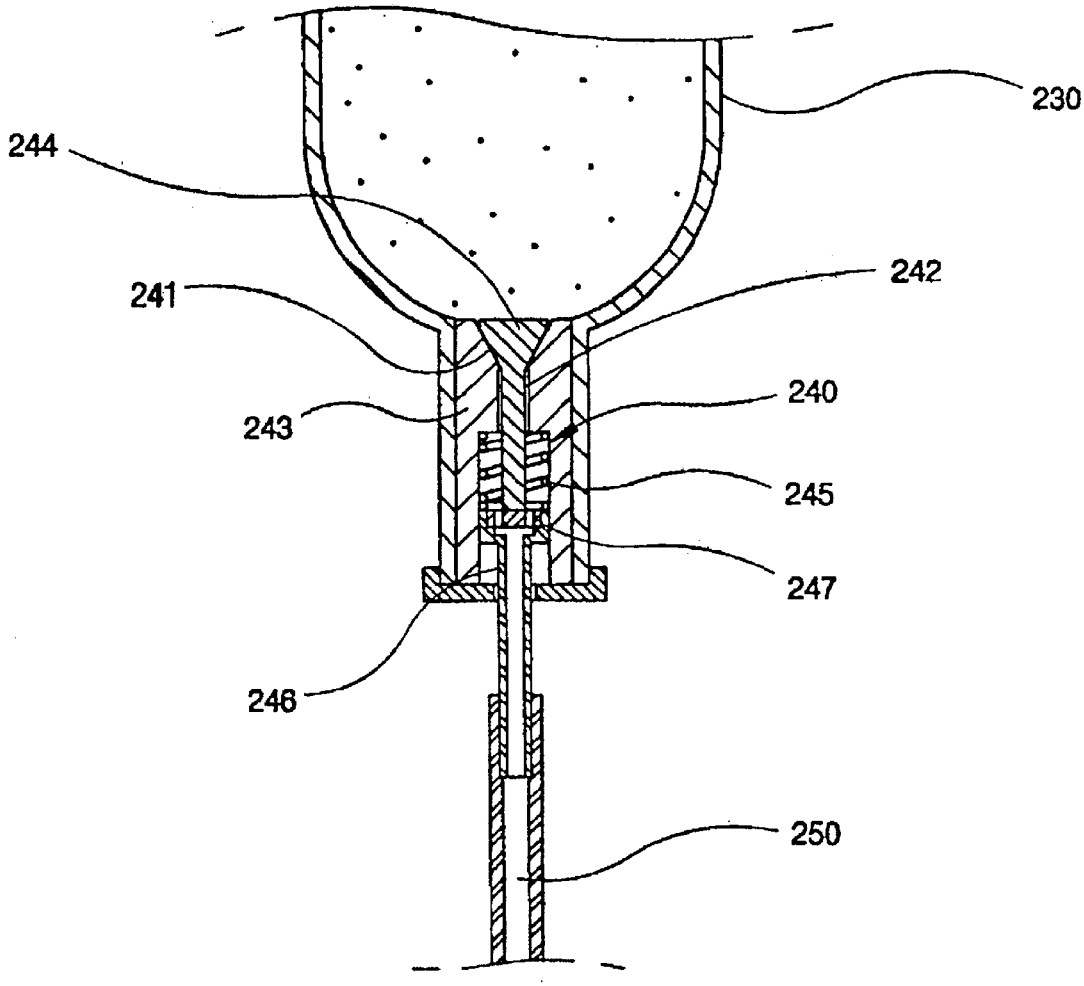
FIG. 4 is a cross-sectional view showing a structure of a refrigerant valve shown in FIG. 1.

Referring to FIG. 4, the refrigerant valve 240 includes a sealing member 243 having a tilt slot 241 and a hole 242 connected down thereto, a valve body 244 connected to the tilt slot 241 and hole 242 of the sealing member 243 to open or close the tilt slot 241 and having an air hole 247 formed at the lower end thereof, a spring 245 for supporting the valve body 244, and an exhaust tube 246 connected to the end of the valve body 244 to provide an exhaust path of the refrigerant. The refrigerant valve 240 can be changed in various manners using known conventional techniques. For example, refrigerant valves are not necessarily modified when they are adopted disposable butane gas containers, as far as the valve has only to be opened by relative motion of the refrigerant vessel 230 and the evaporator tubing 250.

One end of the evaporator tubing 250 is connected to the refrigerant valve 240. The evaporator tubing 250 provides a space for evaporation of the refrigerant exhausted through the refrigerant valve 240 to deprive the beverage of the evaporation heat of the refrigerant. In other words, the endothermic action, mostly on the beverage inside, can be maximized by increasing the space for evaporation in the evaporator tubing 250 to remove the maximum heat from the internal beverage and by forming the evaporator tubing 250 as a helix to increase the length thereof. The evaporator tubing 250 is twisted in a helix form. If possible, the diameter of the evaporator tubing 250 wound in a helix form is preferably at least half that of the container body 210 so as to remove heat uniformly throughout the overall beverage, and the evaporator tubing 250 itself preferably has a diameter of 4 to 5 mm. The diameter of the evaporator tubing 250 wound in a helix form, the diameter of the evaporator tubing 250 itself, and the winding pitch may be changed according to the kind or amount of beverage. Metal having good heat conductivity, such as copper, brass or aluminum, is suitably used as the material of the evaporator tubing 250. In other words, when the evaporator tubing 250 is constructed in such a manner as shown in FIG. 3, a cooled portion becomes longest to increase the contact surface between the evaporator tubing 250 and the beverage, exerting a relatively uniform cooling effect throughout the beverage. The other end of the evaporator tubing 250 is connected to the top surface of the container body 210, that is, a hole 227 formed at one side of the cover member 220. The hole 227 is preferably closed by an adhesive tape 228. In some cases, instead of the adhesive tape 228, another member can be used, which will later be described. Also, in the case where a harmless refrigerant is to be used, the hole 227 may not be formed. Instead, the end of the evaporator tubing 250 may be configured to be directly immersed into the beverage. In this case, the beverage is allowed to circulate, thereby uniformly cooling the beverage.

In other words, if the beverage inside the beverage container 200 is intended to drink in such states as shown in FIGS. 1 and 2, the adhesive tape 228, if any, is torn off and then the end of the handle 226 is lifted, so that a force is applied to the lid member 224, which is then partly severed along the line 222 and bent inside the beverage container 200 while moving by a predetermined angle. Accordingly, the refrigerant vessel 230 which is lightly attached to or contacts the bottom of the lid member 224, is applied to a force by the lid member 224 in a direction in which it is tilted at a predetermined angle, so that it is slightly pushed laterally and is lowered simultaneously. Thus, the valve body 244 supported by the spring 245 is pushed upward by the exhaust tube 256 connected to the evaporator tubing 250 and the tilt slot 241 of the sealing member 243 is opened. Accordingly, the refrigerant under high pressure inside the refrigerant vessel 230 is exhausted to the evaporator tubing 250 under low pressure, that is, under atmospheric pressure, through the exhaust tube 246 and is simultaneously evaporated. The refrigerant evaporated in the evaporator tubing 250 is exhausted to the air through the hole 227. While the refrigerant is evaporated, the heat required for evaporation is removed from the evaporator tubing 250, so that the evaporator tubing 250 is rapidly cooled, thereby rapidly cooling uniformly throughout the wide area of the beverage contained in the beverage container 200. In other words, the rapidly cooled beverage can be consumed by one who opened the lid member 224.

The result of experimentation performed on the self-cooling beverage container according to the present invention using 250 cc of a predetermined beverage maintained at approximately 27° C. showed that the beverage was cooled to 4.5° C. in about 15 seconds. Here, the experimental conditions are a capacity being 355 cc, a refrigerant being of a Freon-series, a refrigerant pressure being close to atmospheric pressure, a diameter of an evaporator tubing being 5 mm, a pitch of the evaporator tubing being 2.5 cm, a diameter of the evaporator tubing wound in a helix being approximately 80% the diameter of the container.

As described above, the self-cooling beverage container according to the present invention has excellent cooling efficiency and manipulation thereof is easy.

Figure 5:
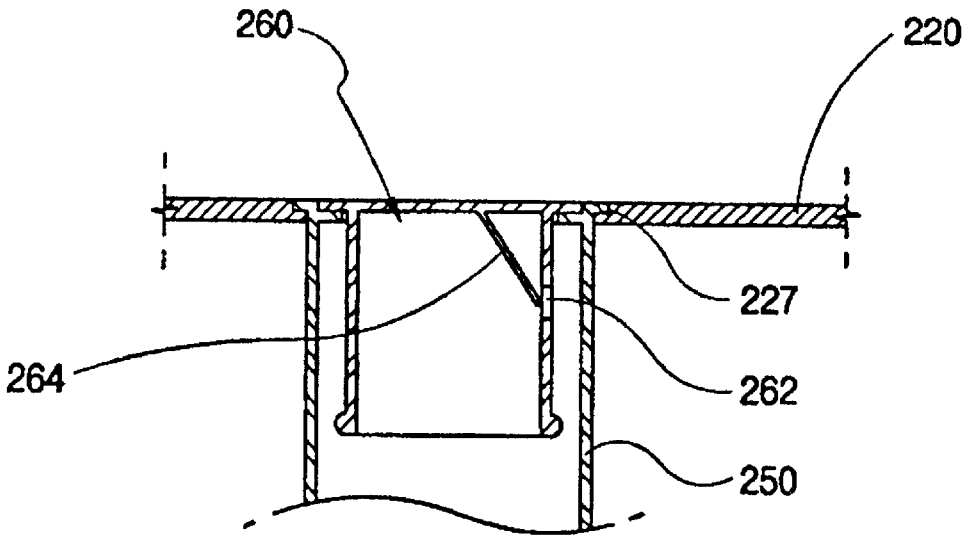
FIG. 5 is a cross-sectional view showing the state in which an exhaust cap is installed at an end of an evaporator tubing.
Figure 6:
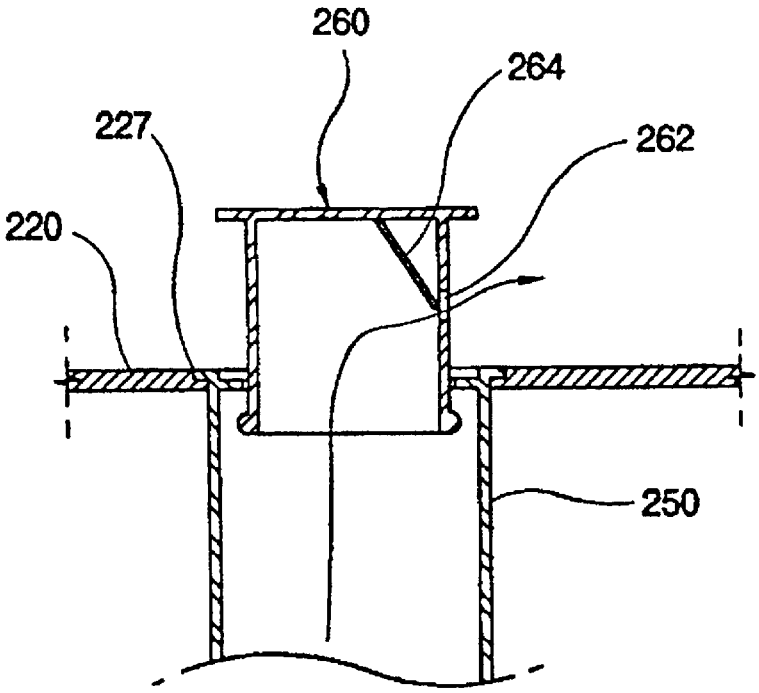
FIG. 6 is a cross-sectional view showing the state in which an exhaust cap is raised so that an evaporated refrigerant is exhausted through an exhaust hole.

As shown in FIGS. 5 and 6, the hole 227 is formed in the cover member 220 on the top surface of the beverage container 200, and one end of the evaporator tubing 250 is connected to the hole 227. As shown, an exhaust cap 260 having its top surface opened and its bottom surface closed and having an exhaust hole 262 formed on its lateral surface, is connected to the end of the evaporator tubing 250. If one who wishes to drink a beverage opens the refrigerant valve 240 in the same process as described above, the refrigerant is evaporated in the evaporator tubing 250. Then, the pressure of the evaporator tubing 250 increases so that the exhaust cap 260 is raised. The evaporated refrigerant is exhausted to the air through the exhaust hole 262. As shown, a film-like sound generating device 264 is installed around the exhaust hole 262 so that characteristic sound can be generated according to the kind of beverage. In the case of installing such exhaust cap 260, provision of the adhesive tape 228 may be omitted.

Figure 7:
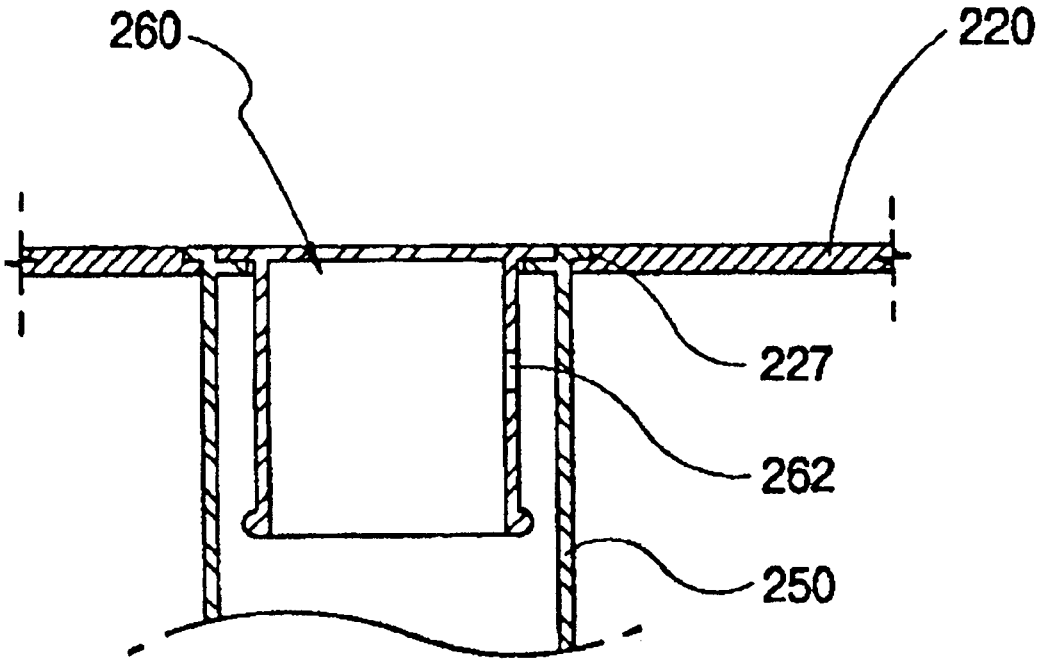
FIG. 7 is a cross-sectional view showing another example of the exhaust caps shown in FIGS. 5 and 6.

As shown in FIG. 7, the sound generating device 264 may not be provided inside the exhaust cap 260. In this case, no sound is generated. The remaining parts of operation are the same as described with reference to FIGS. 5 and 6.

Figure 8:
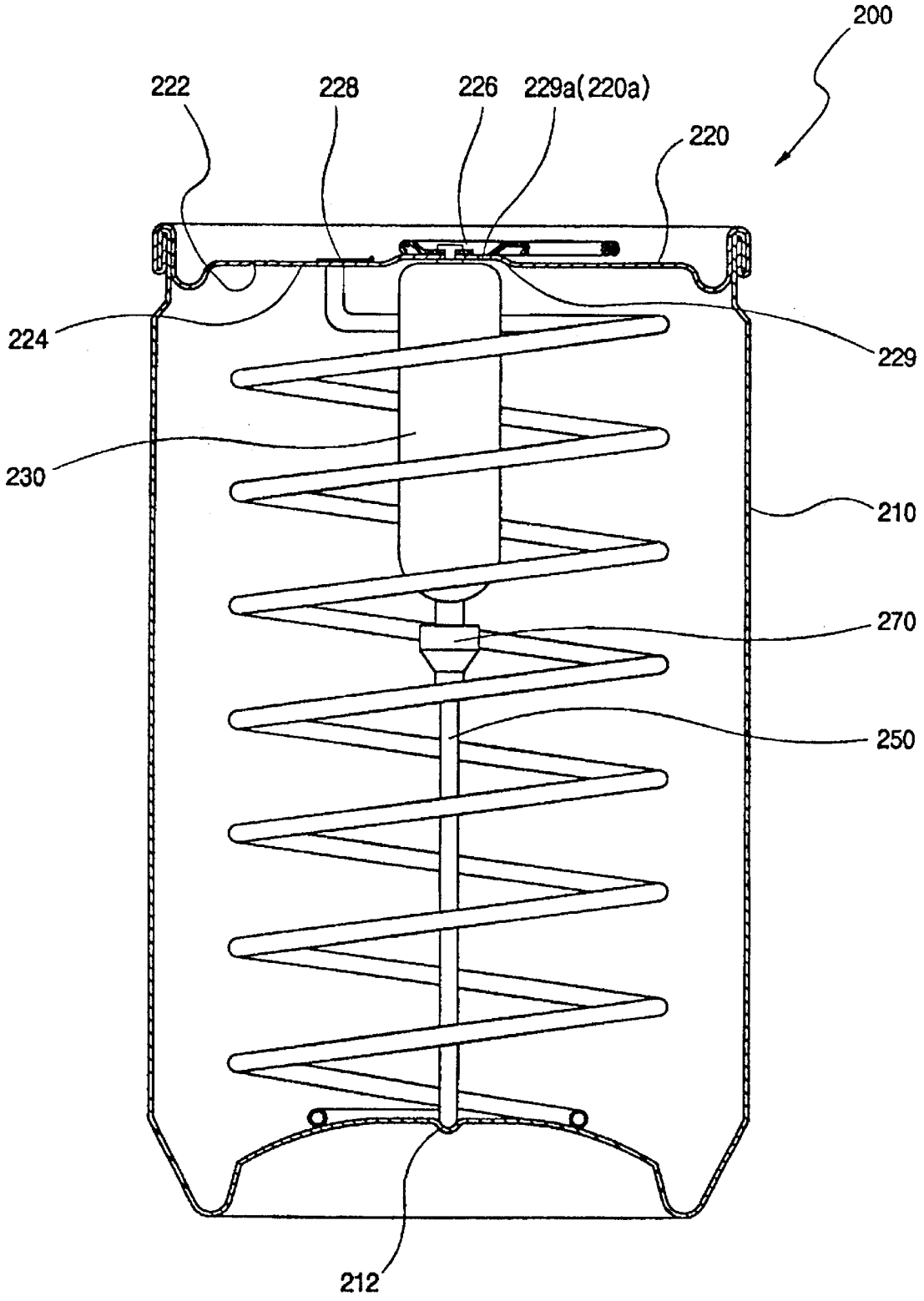
FIG. 8 is a cross-sectional view of a beverage container according to another embodiment of the present invention.
Figure 9:
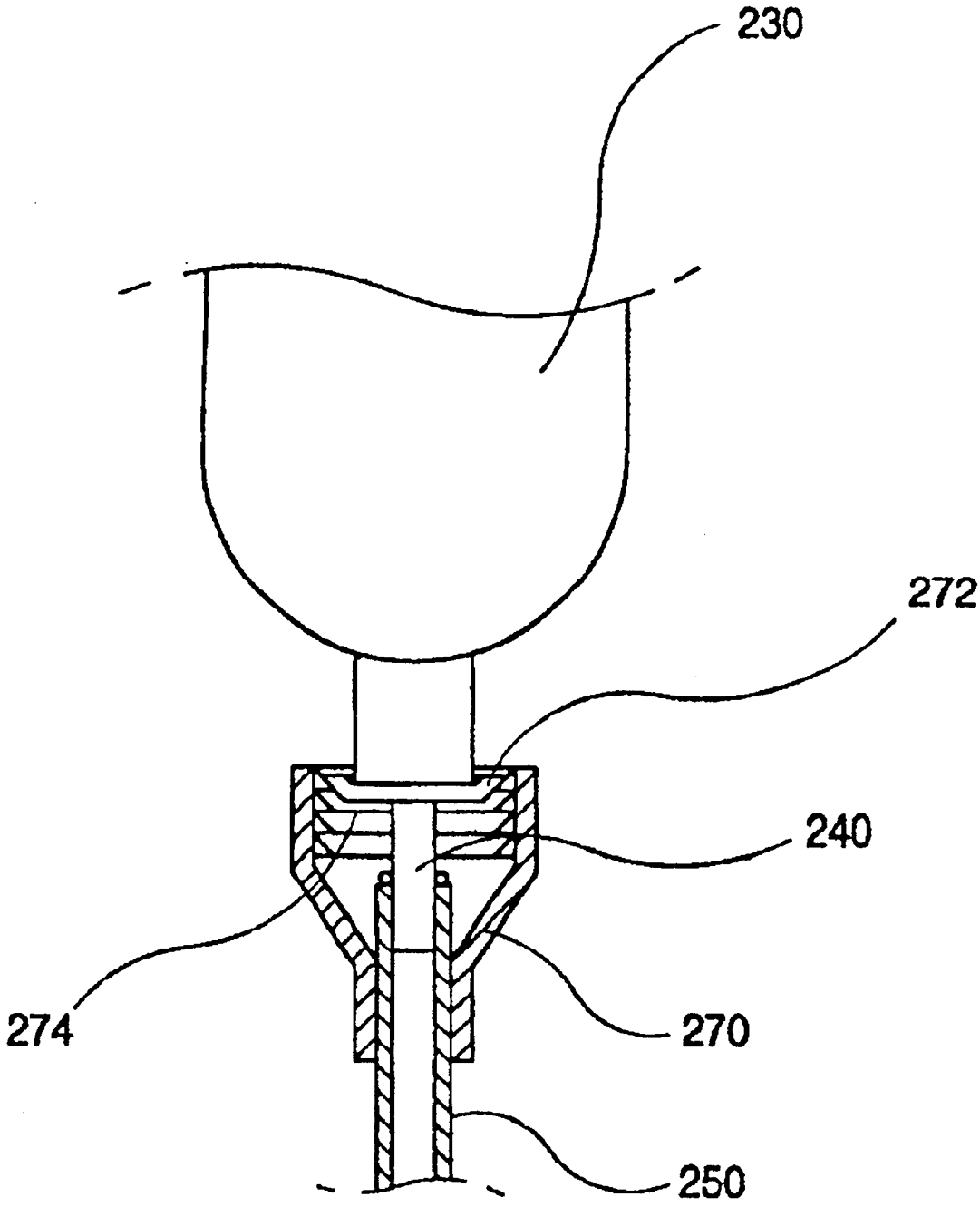
FIG. 9 is a cross-sectional view showing the state in which a locking protrusion and a wedge tube are installed between the refrigerant vessel and the evaporator tubing in FIG. 8.

As shown in FIGS. 8 and 9, in another embodiment of the present invention, the beverage container 200 may be constructed such that the cover member 220 of the beverage container 200, that is, a part of the top surface of the beverage container 200, is made convex upward and, a convex portion 229*a* is formed to provide a recess 229 in which the top end of the refrigerant vessel 230 is accommodated. In this case, the refrigerant valve 240 is opened by gently touching or pressing the convex portion 229*a*. That is to say, in the embodiment, the convex portion 229*a* operates as the valve actuator 220*a*.

As shown in FIG. 9, a tapering locking protrusion 272 is installed at the lower portion of the refrigerant vessel 230, and a wedge tube 270 having a locking flange 274 for preventing the locking protrusion 272 from escaping outside once inserted, is installed at the opposite end of the evaporator tubing 250. If the convex portion 229*a*, that is, the valve actuator 220, is lightly touched or pressed, the refrigerant vessel 230 is lowered to open the refrigerant valve 240 and simultaneously the locking protrusion 272 is fittingly inserted into the wedge tube 270, the state of which is continuously maintained while the refrigerant is continuously exhausted to the evaporator tubing 250. The other construction and operation are the same as described above.

As described above, in the self-cooling beverage container according to the present invention, since evaporation occurs directly at an evaporator tubing contacting a beverage inside the container through a wide area, superb beverage cooling efficiency can be achieved. Also, a lid member can be opened by pulling a handle or lightly touching or pressing a convex portion, that is, the self-cooling beverage container according to the present invention can be easily manipulated. In some cases, characteristic sounds can be generated according to the kind of beverage by installing a sound generating device around an exhaust cap, thereby remarkably attracting the attention of potential consumers. In the self-cooling beverage container according to the present invention, the cooling efficiency thereof can be enhanced by using a smaller amount of refrigerant than in the conventional self-cooling beverage container, and a cooling time can be greatly reduced to approximately 15 seconds, which is much shorter than the conventional cooling time, that is, 2 to 3 minutes, so that a rapidly cooled beverage can be consumed.

Further, it is not necessary to overturn the beverage container before drinking the beverage contained therein. The self-cooling beverage container according to the present invention can be readily packaged for sale without considerably changing conventional beverage manufacturing processes.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A self-cooling beverage container capable of accommodating a beverage and having a lid member formed at either side thereof to be opened, if necessary, to exhaust the beverage outside, the self-cooling beverage container comprising:

a refrigerant vessel provided inside the beverage container and having a refrigerant valve configured to exhaust an internal refrigerant outside;

an evaporator tube having one end connected to the refrigerant valve and the other end led to the outside of the container to allow evaporation of the refrigerant exhausted through the refrigerant valve and to remove an evaporation heat for the refrigerant from the beverage to cool the beverage;

a refrigerant valve actuator configured to actuate the refrigerant valve;

an exhaust cap elevatably installed at the lid member at said other end of the evaporator tube and having an exhaust hole for exhaustion of the evaporated refrigerant formed therein;

wherein the lid member has a severable portion;

wherein the top end of the refrigerant vessel is disposed within a movable radius of the severable portion of the lid member when the lid member is severed and moved inside the beverage vessel, and wherein the refrigerant valve actuator includes the severable portion of the lid member movable inside the beverage container and a handle installed on the lid member and capable of easily severing the lid member;

wherein the top end of the refrigerant vessel is in contact with the lid member; and wherein a tapered locking protrusion is installed at the lower portion of the refrigerant vessel, and a wedge tube having a locking flange for preventing the locking protrusion from escaping outside once inserted, is installed at said end of the evaporator tube which is connected to the refrigerant valve.

2. The self cooling beverage container of claim 1, wherein a sound generating device is installed in the exhaust cap so that a characteristic sound can be generated while the evaporated refrigerant is exhausted through the exhaust hole.

3. The beverage container of claim 1 wherein the lid member includes a convex portion for providing a recess which the top end of the refrigerant vessel contacts inside the container.

4. A self-cooling beverage container capable of accommodating a beverage and having a lid member formed at either side thereof to be opened, if necessary, to exhaust the beverage outside, the self-cooling beverage container comprising:

a refrigerant vessel provided inside the beverage container and having a refrigerant valve configured to exhaust an internal refrigerant outside;

an evaporator tubing having one end connected to the refrigerant valve and the other end led to the outside of a container body to allow evaporation of the refrigerant exhausted through the refrigerant valve and to remove an evaporation heat for the refrigerant from the beverage to cool the beverage;

a refrigerant valve actuator configured to actuate the refrigerant valve, if necessary;

an exhaust cap elevatably installed at said other end of the evaporator tubing and having an exhaust hole for exhaustion of the evaporated formed on a lateral surface thereof; and a sound generating device installed in the exhaust cap such that a characteristic sound can be generated while the evaporated refrigerant is exhausted through the exhaust hole.

* * * * *